US007509732B2

(12) United States Patent
Kumakura

(10) Patent No.: US 7,509,732 B2
(45) Date of Patent: Mar. 31, 2009

(54) CRIMPING APPARATUS FOR TERMINAL

(75) Inventor: Hideto Kumakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/541,570

(22) Filed: Oct. 3, 2006

(65) Prior Publication Data

US 2007/0077807 A1 Apr. 5, 2007

(30) Foreign Application Priority Data

Oct. 3, 2005 (JP) ..... 2005-290516

(51) Int. Cl.
*H01R 43/048* (2006.01)
*H01R 43/058* (2006.01)

(52) U.S. Cl. ..... 29/753; 29/761; 29/861; 29/863; 72/409.14; 439/495; 439/877

(58) Field of Classification Search ..... 29/761, 29/753, 33 M, 751, 863, 757, 758, 747, 857.861; 72/416, 409.14; 439/422, 495, 877
See application file for complete search history.

(56) References Cited

U.S. PATENT DOCUMENTS 2,668,950 A * 2/1954 Bohaboy et al. ..... 29/753
4,884,984 A * 12/1989 Matsumoto ..... 439/877
5,632,081 A * 5/1997 Gerhard, Jr. ..... 29/751
7,124,499 B2 * 10/2006 Villeneuve et al. ..... 29/753

FOREIGN PATENT DOCUMENTS

JP 2003223948 A * 8/2003
JP 1 363 362 A1 11/2003

* cited by examiner

*Primary Examiner*—David P Bryant
*Assistant Examiner*—Livius R Cazan
(74) *Attorney, Agent, or Firm*—Kratz, Quintos & Hanson, LLP

(57) ABSTRACT

The crimping apparatus crimps a conductor of a FFC (flexible flat cable) to a terminal. The crimping apparatus has a crimping portion and a pressing portion. The crimping portion has an anvil and a crimper which pinch the terminal and the conductor of FFC therebetween. The pressing portion has a pair of stopping bars. The stopping bars each are inserted into a through hole defined in the crimper. The stopping bars of the pressing portion press the conductor positioned on a bottom wall of the terminal against the bottom wall. The crimping portion crimps crimping pieces of the terminal with the stopping bars pressing the conductor against the bottom wall.

1 Claim, 9 Drawing Sheets

CRIMPING APPARATUS FOR TERMINAL

BACKGROUND OF THE INVENTION

1. Field of the Invention

The present invention relates to a crimping apparatus for fitting a terminal to a conductor of a flat circuit such as FPC (flexible printed circuit) and FFC (flexible flat cable).

2. Background Art

An automotive vehicle has various types of electrical equipment. The automotive vehicle is arranged with wiring harnesses to supply electrical power from a battery and to transmit control signals from control units to the electrical equipment. The wiring harnesses have electrical cables, connectors, etc. The connector has a housing made of an insulating synthetic resin and a terminal received in the housing. The terminal is fitted to an end of one of the electrical cables.

Recently, an automotive vehicle was requested having multi-functions. Thus, the automotive vehicle would have an increased number of electronic instruments. This increases the number of cables of the wiring harnesses so that the wiring harnesses tend to increase in weight and volume.

Thus, it has been proposed that flat circuits such as FFC or FPC are used for the cables of the wiring harnesses to achieve lightness in weight and compactness of the wiring harnesses.

The flat circuit has a conductor having a rectangular section and a film-type sheath to cover the conductor. The flat circuit is defined in a flat band. A plurality of conductors are extended straight and parallel to each other. The sheath insulates the conductors from each other.

Before a terminal is fitted to the flat circuit, the conductor is bent so as to fit with the terminal, for example, as disclosed in EP Application No. 1363362 B1(Document 1).

However, a terminal fitting process shown in Document 1 needs a metallic die for forming the conductor to fit with the terminal and another metallic die for crimping the terminal to the conductor. This increases the number of metallic dies, resulting in a cost increase.

Furthermore, as disclosed in Document 1, a flat conductor is directly fitted to a terminal without forming of the conductor so as to fit with the terminal. But, this fitting process can not reliably fit the terminal to the conductor, because the flat conductor tends to slide from the terminal.

Hence, an object of the present invention is a crimping apparatus that can reliably fit a terminal to a conductor of a flat circuit with a lesser cost increase.

SUMMARY OF THE INVENTION

To achieve the object, a crimping apparatus of the invention is provided for positioning a conductor of a flat circuit on a bottom wall of an electrical connection portion of a terminal and for crimping the terminal by a crimping piece raised from the bottom wall to press-fit the conductor to the terminal. The crimping apparatus includes:

a pressing means for pressing the conductor positioned on the bottom wall against the bottom wall and a crimping means for crimping the crimping piece with the conductor being pressed on the bottom wall by the pressing means.

This requires no additional die when the terminal is fitted to the conductor of the flat circuit, enabling a lesser cost increase. The pressing means presses the conductor of the flat circuit on the bottom wall of the terminal. Thus, when the terminal is fitted to the conductor, the terminal is surely prevented from shifting relative to the conductor. Accordingly, the terminal is more reliably fitted to the conductor of the flat circuit.

Preferably, the crimping means has a pair of dies coming close to and apart from each other to pinch and crimp the crimping piece, and the pressing means has a stopping bar passing through a through hole defined in one of the dies and retractively extending toward the other die.

Thus, the pressing means has a stopping bar penetrating through the through hole defined in one of the dies of the crimping means. This does not require use of another die when the terminal is fitted to the conductor of the circuit, enabling a lesser cost increase.

Preferably, a plurality of the stopping bars are disposed parallel to each other along a lateral direction of the terminal.

Thus, the stopping bars can surely press the conductor of the flat circuit on the bottom wall of the flat circuit. The conductor is pressed at plural points so that the pressed conductor does not shift undesirably. Hence, the terminal is more reliably fitted to the conductor of the flat circuit.

Preferably, the crimping means has a pair of dies coming close to and apart from each other to pinch and crimp the crimping piece, and the pressing means has a main body and a stopping die, the main body being slidable along directions in which the pair of dies come close to and apart from each other, the stopping die having a convex projecting from the main body to press the conductor.

Thus, the pressing means has a stopping die slidable along directions in which the pair of dies come close and apart from each other. The stopping die can be fitted on one of the dies, requiring use of no other die when the terminal is fitted to the conductor of the flat circuit, surely enabling a lesser cost increase.

Preferably, a plurality of the stopping dies are disposed parallel to each other along a longitudinal direction of the terminal.

Thus, the stopping died can surely press the conductor of the flat circuit on the bottom wall of the flat circuit. The conductor is pressed at plural points so that the pressed conductor does not shift undesirably. Accordingly, the terminal is more reliably fitted to the conductor of the flat circuit.

BRIEF DESCRIPTION OF THE ACCOMPANIED DRAWINGS

DETAILED DESCRIPTION OF PREFERRED EMBODIMENTS

Next, referring to FIGS. 1 to 14, a crimping apparatus of a first embodiment according to the present invention will be discussed.

Figure 1:
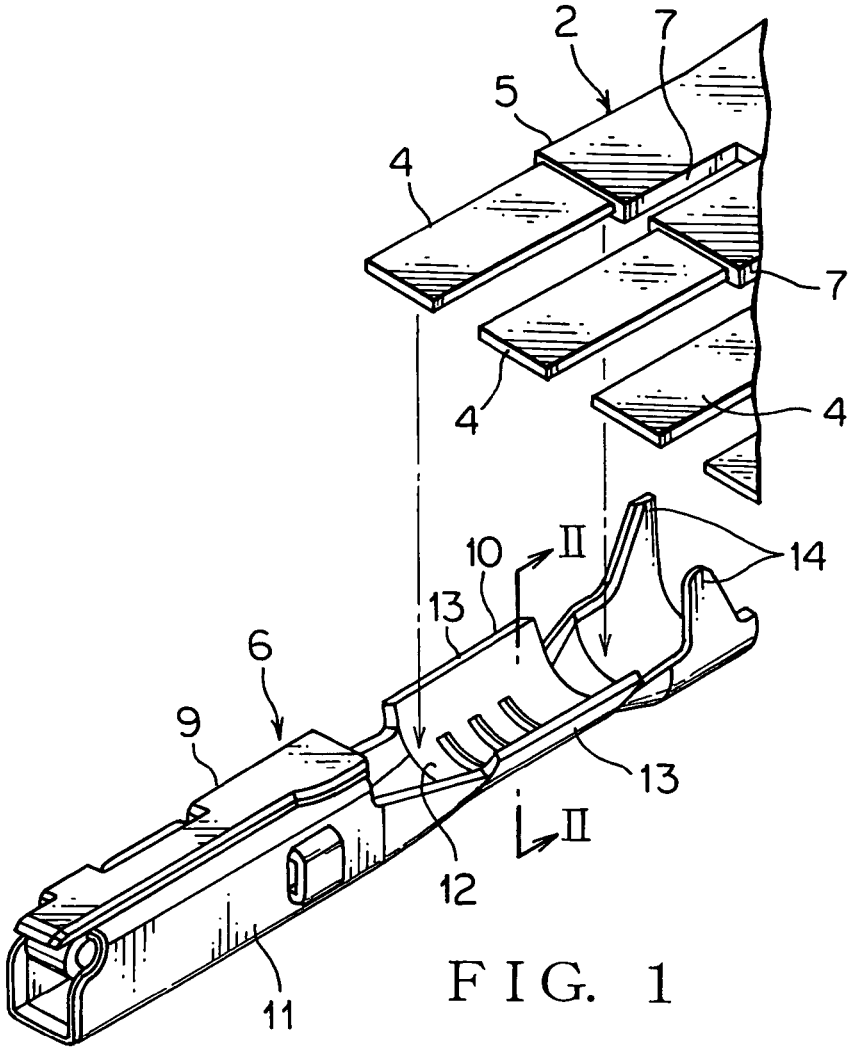
FIG. 1 is a perspective view showing a terminal and a FFC fitted to each other by crimping apparatus of a first embodiment of the present invention.
Figure 5:
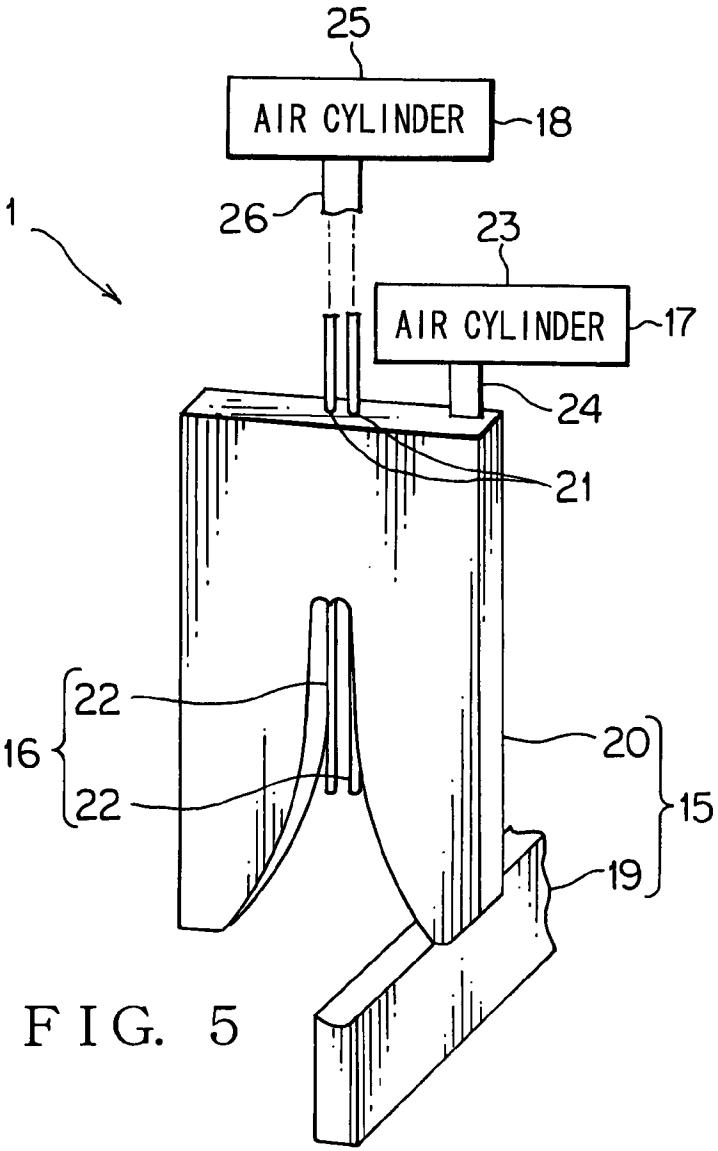
FIG. 5 is an explanatory view showing a general configuration of a crimping apparatus of a first embodiment of the invention.

A crimping apparatus 1 shown in FIG. 5 serves to fit or crimp a conductor 4 of a FFC (Flexible Flat Cable) 2, which is a flat circuit shown in FIG. 1, to a terminal (terminal assembly) 6.

A FFC 2, as shown in FIG. 1, has a plurality of conductors 4 and sheathes 5 covering the conductors 4 to be defined in a flat band.

The conductor 4 is made of an electrically conductive metal. The conductor 4 includes copper or a copper alloy. The conductor 4 has a rectangular section and extends straight. A plurality of the conductors 4 are arranged to be parallel to each other.

The sheath 5 is made of an insulating synthetic resin and defined in a band. The sheath 5 is a flat band covering the conductor 4. The sheath 5 electrically insulates the conductors 4 from each other. The FFC 2 has a slit 7 between the conductors 4 and the sheath 5 is removed at one end so that the conductor 4 is exposed.

The flat circuit described in this specification has a plurality of conductors and sheathes covering the conductors to be defined in a flat band.

The terminal 6 is defined by bending an electrically conductive plate and, as shown in FIG. 1, unitarily has an electrical contact portion 9 connected to an opposed terminal and an electrical connection portion 10 connected to a conductor 4 of the FFC 2.

The electrical contact portion 9 has a barrel 11 having square section and a resilient piece (not shown) received in the barrel 11. The resilient piece biases an inserted portion like a tab of the opposed terminal toward an inner surface to pinch the inserted portion between the resilient piece and the inner surface. Thereby, the electrical contact portion 9 connects to the opposed terminal mechanically and electrically.

Figure 2:
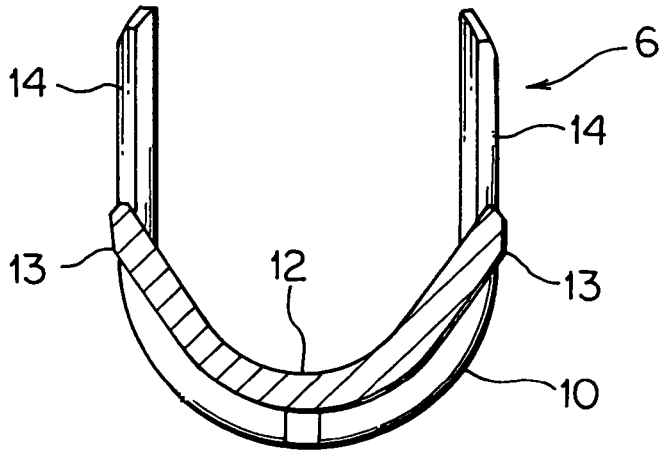
FIG. 2 is a sectional view taken along line II-II of FIG. 1.

The electrical connection portion 10, as shown in FIG. 2, has a bottom wall 12 having an arc-shape section, a pair of conductor crimping pieces 13, and a pair of sheath crimping pieces 14. The bottom wall 12 is contiguous with an outer wall of the barrel 11. On the bottom wall 12, an end of the FFC 2 is laid. That is, the conductor 4 exposed at the end of the FFC 2 is laid on the bottom wall 12.

The conductor crimping piece 13 corresponds to a crimping piece described in the claims. The pair of conductor crimping pieces 13 are positioned in a longitudinal middle of the bottom wall 12. The crimping pieces 13 rise from each lateral side of the bottom wall 12. The crimping pieces 13 are bent such that side edges of the crimping pieces 13 come close to the bottom wall 12. Thereby, the conductor 4 of the FFC 2 is pinched between the crimping pieces 13 and the bottom wall 12. Accordingly, the crimping pieces 13 crimp the conductor 4 of the FFC 2.

The sheath crimping pieces 14 are positioned at an end opposed to the electrical contact portion 9 in a longitudinal direction of the bottom wall 12. The sheath crimping pieces 14 rise from each lateral side of the bottom wall 12. The sheath crimping pieces 14 are bent such that side edges of the sheath crimping pieces 14 come close to the bottom wall 12. Thereby, between the sheath crimping pieces 14 and the bottom wall 12, the sheath 5 of the FFC 2 is pinched. Accordingly, the sheath crimping pieces 14 crimp the sheath 5 of the FFC 2.

Figure 3:
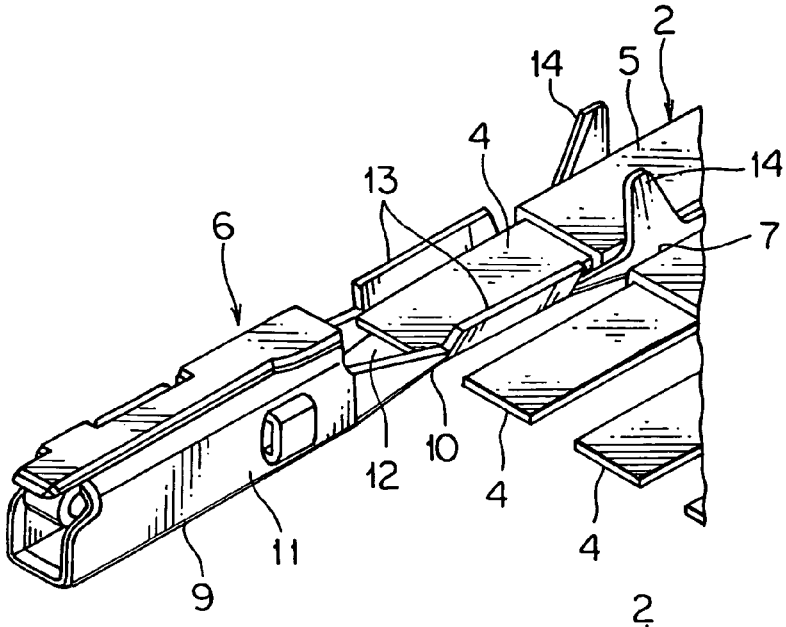
FIG. 3 is a perspective view showing a state in which a FFC conductor is positioned on a bottom wall of a terminal of FIG. 1.
Figure 4:
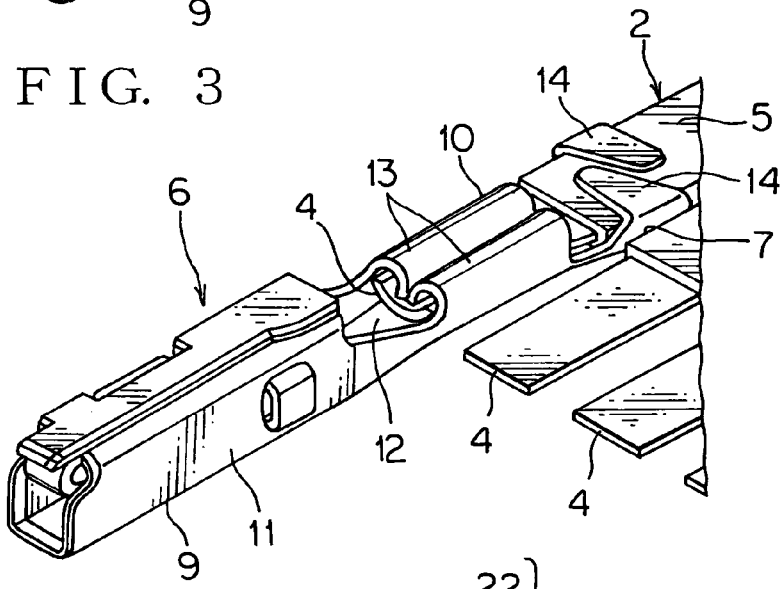
FIG. 4 is a perspective view showing a state in which a crimping piece of the terminal of FIG. 3 has been crimped.

In the terminal 6, as shown in FIG. 3, an end of the FFC 2 is positioned on the bottom wall 12. Then, the crimping apparatus 1 shown in FIG. 5 bends the crimping pieces 13 such that the top edges of the crimping pieces 13 come close to the bottom wall 12. The crimping apparatus 1 also bends the sheath crimping pieces 14 such that the top edges of the sheath crimping pieces 14 come close to the bottom wall 12. As shown in FIG. 4, the crimping pieces 13, 14 of the terminal 6 crimp the conductor 4 and the sheath 5 of the FFC 2, so that the terminal 6 is fitted to one end of the FFC 2.

The crimping apparatus 1, as shown in FIG. 5, has a main base body (not shown), a crimping portion 15 as a crimping means, a pressing portion 16 as a pressing means, an air cylinder 17 as an actuating device, and an air cylinder 18 as a second actuating device. The main base body is disposed on a floor of a factory.

The crimping portion 15 has an anvil 19 as a die and a crimper 20 as another die. The anvil 19 is fixed on the main base body. On the anvil, the terminal 6 is laid and positioned.

The crimper 20 is opposed to the anvil 19 with a space therebetween and is supported by the main base body so as to come close and apart from the anvil 19. With the crimper 20 being apart from the anvil 19, the terminal 6 and an end of the FFC 2 are positioned on the anvil 19. The crimper 20 comes close to the anvil 19 to pinch the terminal 6 and the end of the FFC 2 therebetween to crimp the crimping pieces 13, 14.

Figure 6:
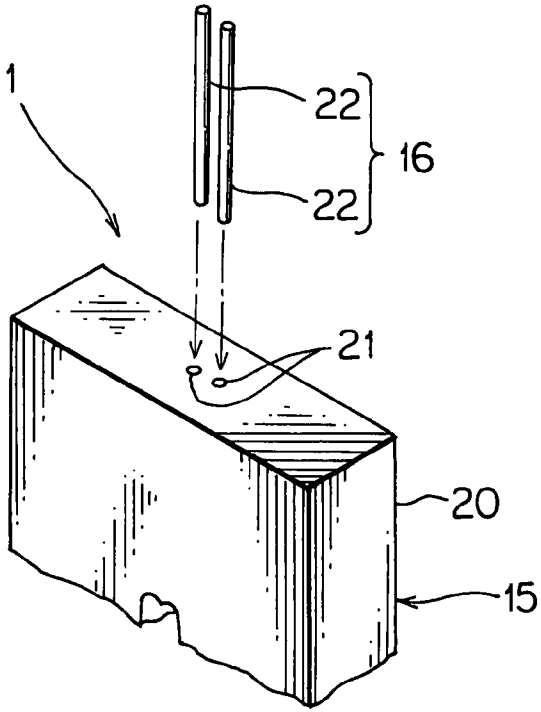
FIG. 6 is a perspective view showing a primary part of a crimper of the crimping apparatus of FIG. 5.

The crimper 20, as shown in FIGS. 5 and 6, is formed with a plurality of through holes 21. The through holes 21 extend straight and penetrate through the crimper 20 along a direction in which the crimper 20 comes close to and apart from the anvil 19. The through hole 21 is open in a recess of the crimper 20. The recess positions the terminal 6 therein.

In the illustrated example, a pair of the through holes 21 are provided. The pair of through holes 21 are positioned along a lateral direction of the terminal 6 laid on the anvil 19. The through holes 21 are parallel to each other.

The pressing portion 16 has a plurality of stopping bars 22. In the illustrated example, a pair of the stopping bars 22 are provided. The stopping bar 22 is a cylindrical rod having a circular section and received into through holes 21. The stopping bar 22 is supported slidably by the crimper 20 along directions in which the crimper 20 comes close to and apart from the anvil 19. Thus, the stopping bar 22 moves toward and apart from the anvil 19. The pair of stopping bars 22 each are received in the through hole 21. The pair of stopping bars 22 are in a row along a lateral direction of the terminal 6 laid on the anvil 19.

The air cylinder 17 of the actuator device has a cylinder body 23 and a rod 24 retractively extending from the cylinder body 23. The cylinder body 23 is fixed on the main base body. The rod 24 is secured to the crimper 20. The air cylinder 17 extends the rod 24 from the cylinder body 23 so that the crimper 20 moves toward the anvil 19, while the air cylinder 17 retracts the rod 24 into the cylinder body 23 so that the crimper 20 moves apart from the anvil 19.

The air cylinder 18 of the second actuating device has a cylinder body 25 and a rod 26 retractively extending from the cylinder body 25. The cylinder body 25 is fixed on the crimper 20. The rod 26 is secured to the stopping bars 22. The air cylinder 18 extends the rod 26 from the cylinder body 25 so that the stopping bars 22 move toward the anvil 19 from the crimper 20, while the air cylinder 18 retracts the rod 26 into the cylinder body 25 so that the stopping bars 22 move back into the crimper 20.

Figure 11:
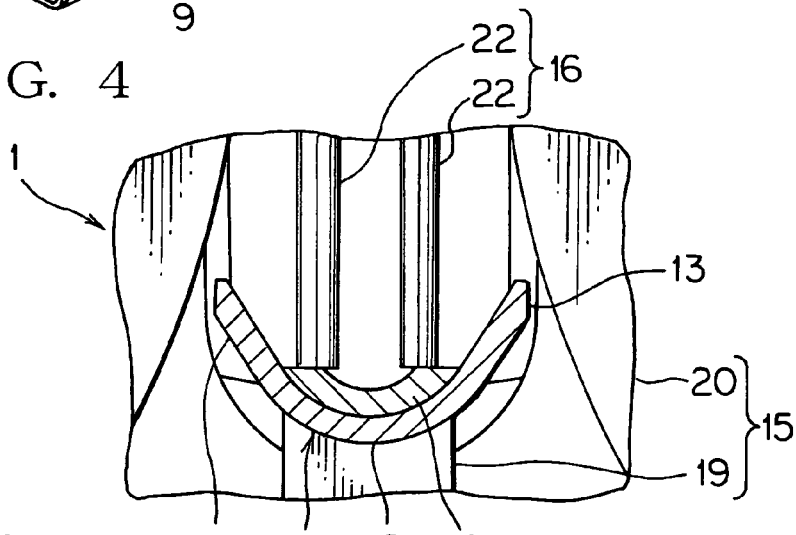
FIG. 11 is an enlarged explanatory view showing a part XI of FIG. 10.
Figure 7:
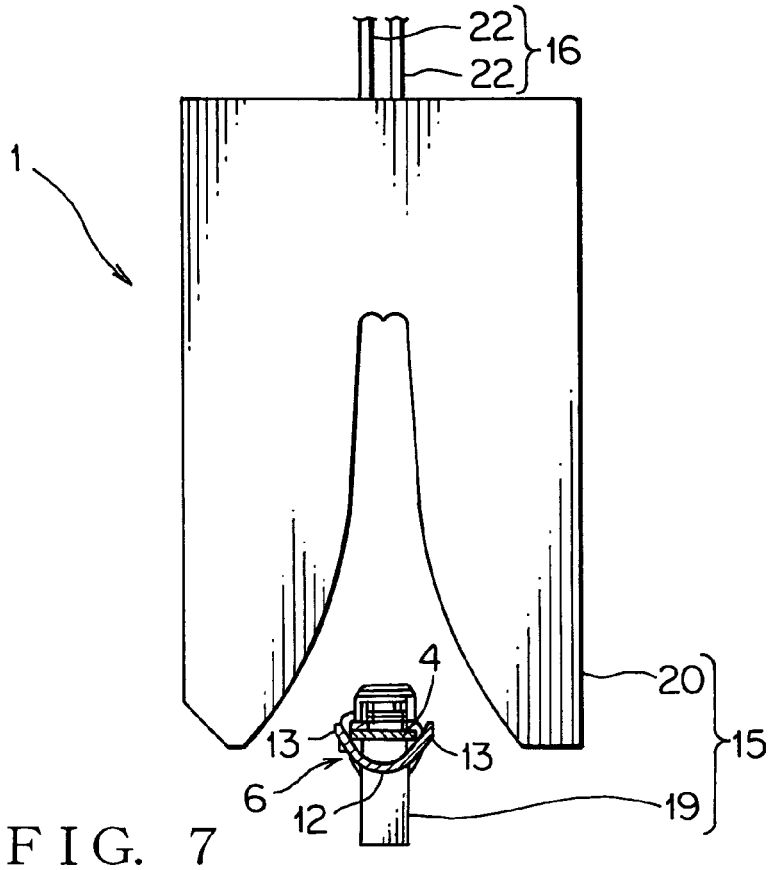
FIG. 7 is an explanatory view showing a state in which the terminal and the FFC are positioned on an anvil of the crimping apparatus of FIG. 5.
Figure 8:
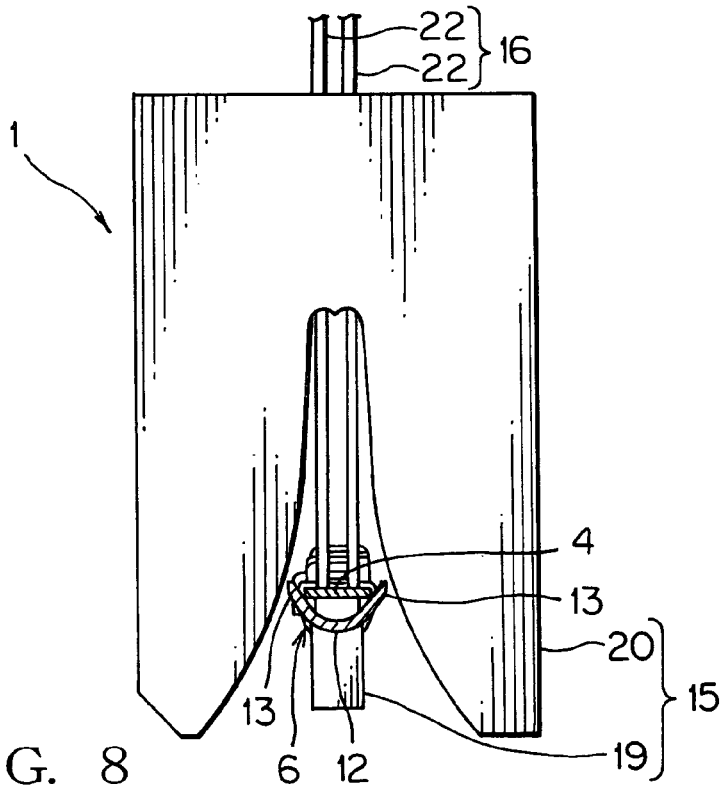
FIG. 8 is an explanatory view showing a state in which a stopping bar of the crimping apparatus of FIG. 7 is contacting the FFC.
Figure 9:
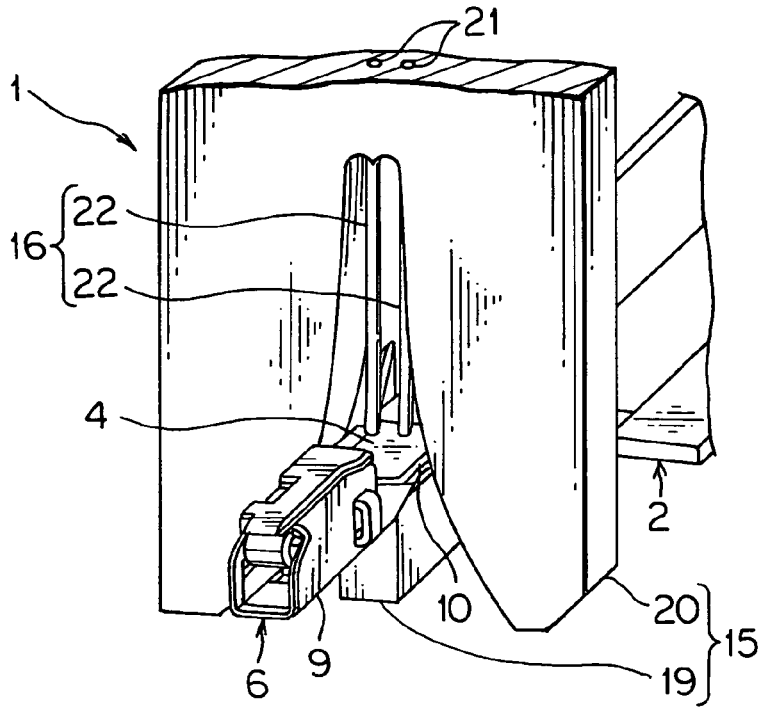
FIG. 9 is a perspective view showing a state in which a stopping bar of the crimping apparatus of FIG. 7 is contacting the FFC.
Figure 10:
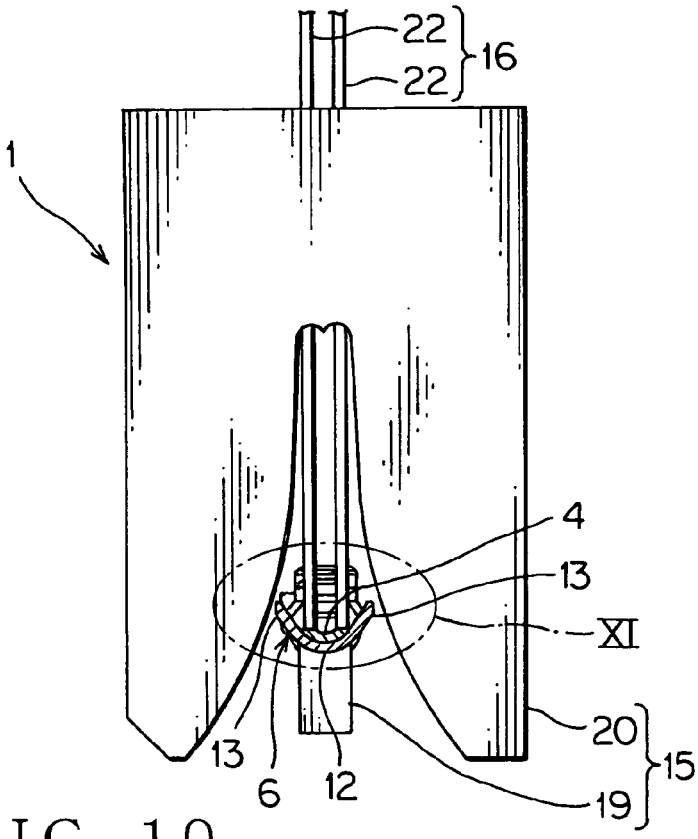
FIG. 10 is an explanatory view showing a state in which the stopping bar of FIG. 8 is pressing the FFC conductor against a bottom wall of the terminal.

In thus configured crimping apparatus 1, the terminal 6 is fitted to the conductor 4 of the FFC 2 as described hereinafter. First, as shown in FIG. 7, the terminal 6 is laid on the anvil 19 with the crimper 20 and the anvil 19 having a space therebetween. Then, on the bottom wall 12 of the terminal 6, the exposed conductor 4 which is an end of the FFC 2 is arranged. Meanwhile, the rods 24, 26 of the air cylinders 17, 18 have been retracted. Then, the rod 26 of the air cylinder 18 extends so that, as shown in FIGS. 8 and 9, the stopping bars 22 extend from the crimper 20 to the anvil 19 to contact leading ends of the stopping bars 22 with the conductor 4 of the FFC 2. A further extension of the rod 26 makes the stopping bars 22 press the conductor 4 against the bottom wall 12. Thereby, as shown in FIGS. 10 and 11, the conductor 4 of FFC is bent along the bottom wall 12 to closely contact the bottom wall 12.

Figure 12:
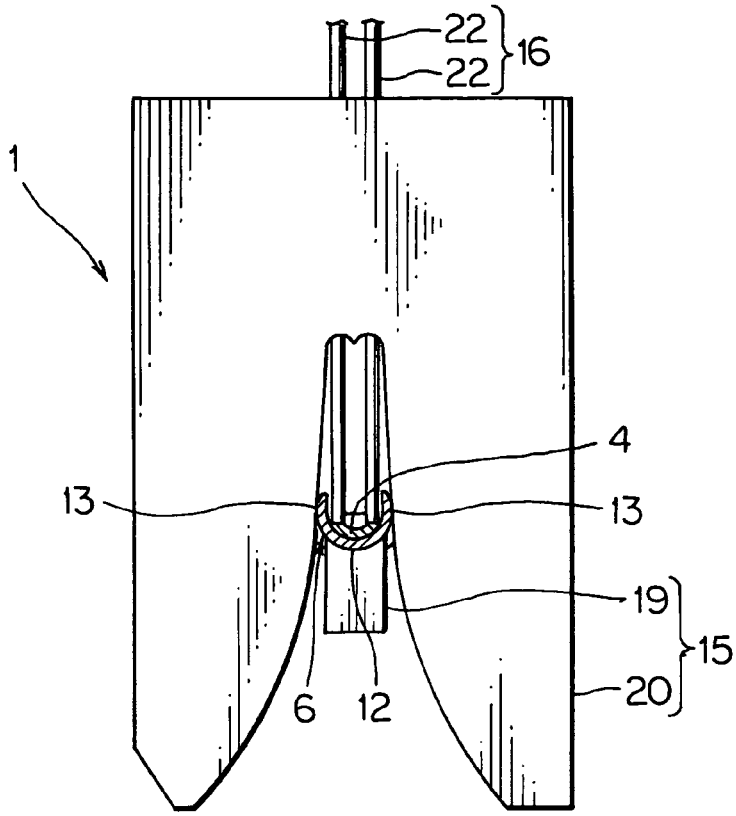
FIG. 12 is an explanatory view showing a state in which the anvil and the crimper have come toward each other of FIG. 10.
Figure 13:
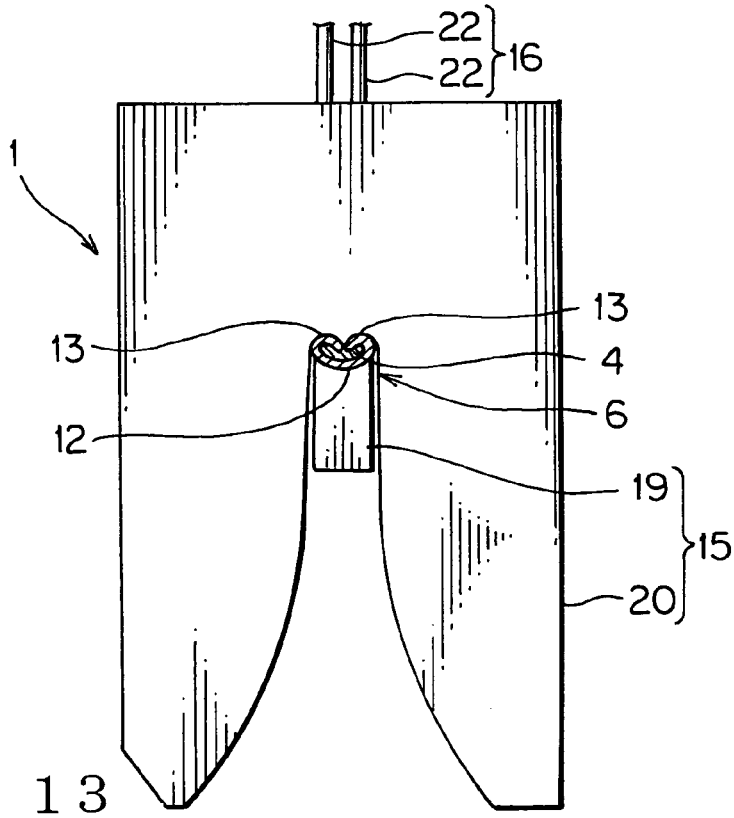
FIG. 13 is an explanatory view showing a state in which the terminal and the FFC conductor are pinched between the anvil and the crimper.

Then, the rod 26 of the air cylinder 18 gradually retracts while the rod 24 of the air cylinder 17 gradually extends. Thereby, as shown in FIG. 12, the crimper 20 comes close to the anvil 19 with the stopping bars 22 pressing the conductor 4 of the FFC 2 against the bottom wall 12. This, as shown in FIG. 13, crimps the crimping pieces 13, 14 with the terminal 6 and the conductor 4 of the FFC 2 being pinched between the anvil 19 and the crimper 20, so that the terminal 6 is secured to the FFC 2. Thus, the anvil 19 and the crimper 20 crimp the crimping pieces 13, 14 with the stopping bars 22 pressing the conductor 4 of the FFC 2 against the bottom wall 12 to press-fit the conductor 4 to the terminal 6.

Figure 14:
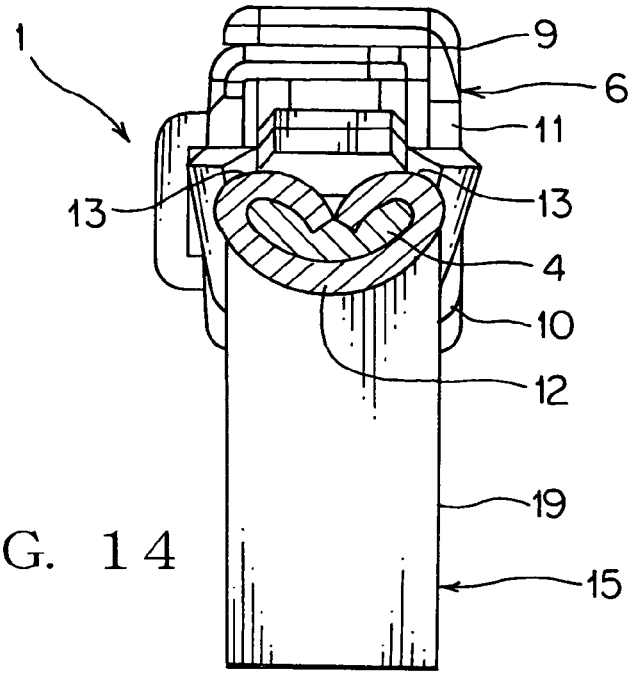
FIG. 14 is an explanatory view showing the terminal fitted to the FFC of FIG. 13.

Then, the rod 24 of the crimper 20 retracts so that the crimper 20 comes apart from the anvil 19 to take the terminal 6 off the anvil 19 in FIG. 14. In the same way as described above, a next terminal 6 is laid on the anvil 19 of the terminal 6 to secure the terminal 6 to the FFC 2.

In the embodiment, the pressing portion 16 presses the conductor 4 of the FFC 2 against the bottom wall 12 of the terminal 6 so that the conductor 4 can be fitted on the crimping portion 15. This does not require another die used when the terminal 6 is fitted to the conductor 4 of the FFC 2, allowing a lesser cost increase without an additional die.

Furthermore, the pressing portion 16 presses the conductor 4 of the FFC 2 against the bottom wall 12 of the terminal 6 so that the relative shift of the conductor 4 and the terminal 6 is prevented when the conductor 4 is fitted to the terminal 6. Thus, the terminal 6 is surely secured to the conductor 4 of the FFC 2.

Since the pressing portion 16 has the stopping bars 22 inserted into the through holes 21 defined in the crimper 20 of the crimping portion 15, another die is not required when the terminal 6 is fitted to the conductor 4 of the FFC 2, allowing a lesser cost increase.

The stopping bars 22 are arranged along a lateral direction of the terminal 6, so that the stopping bars 22 surely press the conductor 4 of the FFC 2 against the bottom wall 12 of the terminal 6. The stopping bars 22 press the conductor 4 at plural points, preventing an undesirable shift of the pressed conductor 4. Thus, the terminal 6 is surely fitted to the conductor 4 of the FFC 2.

Next, referring to FIGS. 15 to 18, a crimping apparatus 1 of a second embodiment according to the present invention will be discussed. The same parts as those of the first embodiment have the same reference numerals and the descriptions thereof will not be repeated.

The crimping apparatus 1 of the second embodiment has a pressing portion 16 provided with a pair of stopping dies 27. The stopping dies 27 each are a flat plate having a comparatively large thickness and are spaced from and opposed to each other in a longitudinal direction of a terminal 6 arranged on the anvil 19. Between the stopping dies 27, a crimper 20 is disposed to be positioned therein. The stopping dies 27 contact the crimper 20 so as to slide along directions in which the crimper 20 comes close to and apart from the anvil 19. The pair of stopping dies 27 are in a row in a longitudinal direction of the terminal 6 set on the anvil 19. The stopping dies 27 are fitted to the rod 26 of the air cylinder 18, and the stopping dies 27 comes close to and apart from the anvil 19 according to extension and retraction of the rod 26.

The stopping die 27 has a main body 28 supported by the crimper 20 slidably along the extension and retraction direction of the crimper 20. The stopping die 27 has a convex portion 29 projecting from the main body 28 toward the anvil 19. The convex portion 29 has a width progressively smaller toward the anvil 19. The leading end of the convex portion has a width smaller than a distance between the pair of crimping pieces 13 of the terminal 6. The stopping dies 27 can press the conductor 4 of the FFC 2 against the bottom wall 12 when the rod 26 of air cylinder 18 extends.

Figure 15:
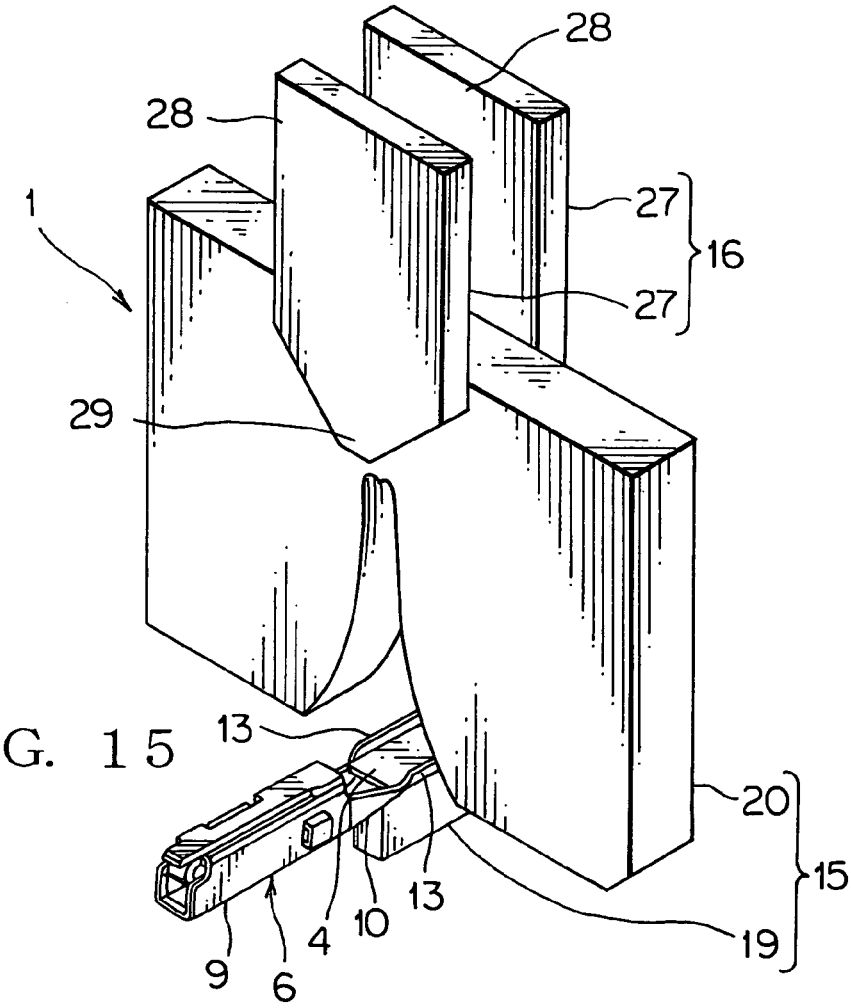
FIG. 15 is an explanatory view showing a general configuration of a crimping apparatus of a-second embodiment of the invention.
Figure 16:
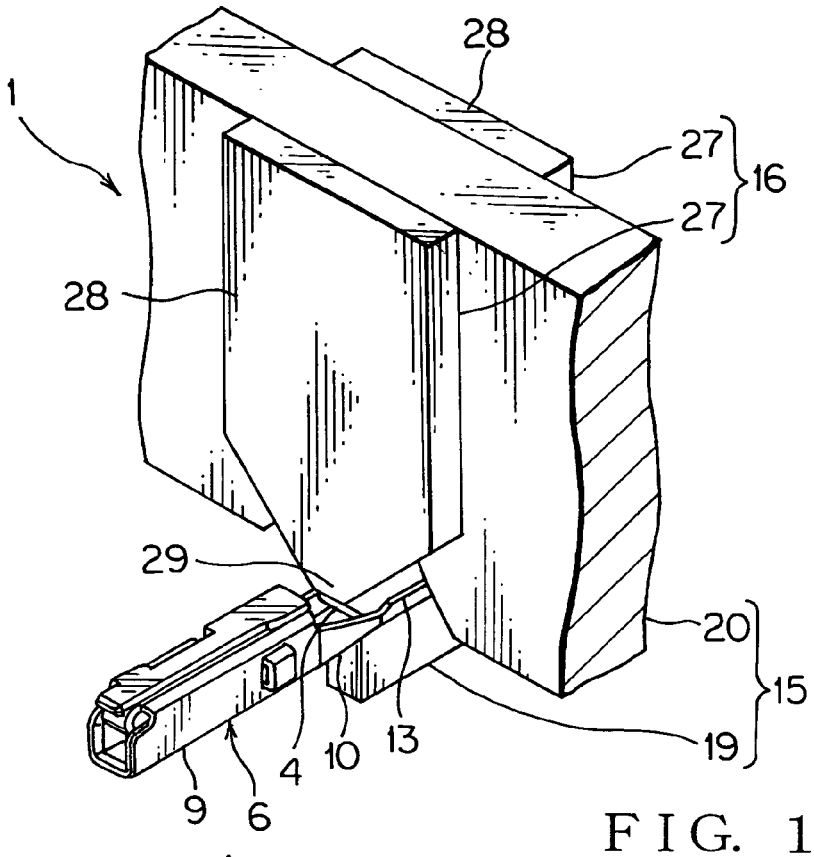
FIG. 16 is an explanatory view showing a state in which a stopping die of the crimping apparatus of FIG. 15 is contacting the FFC.
Figure 17:
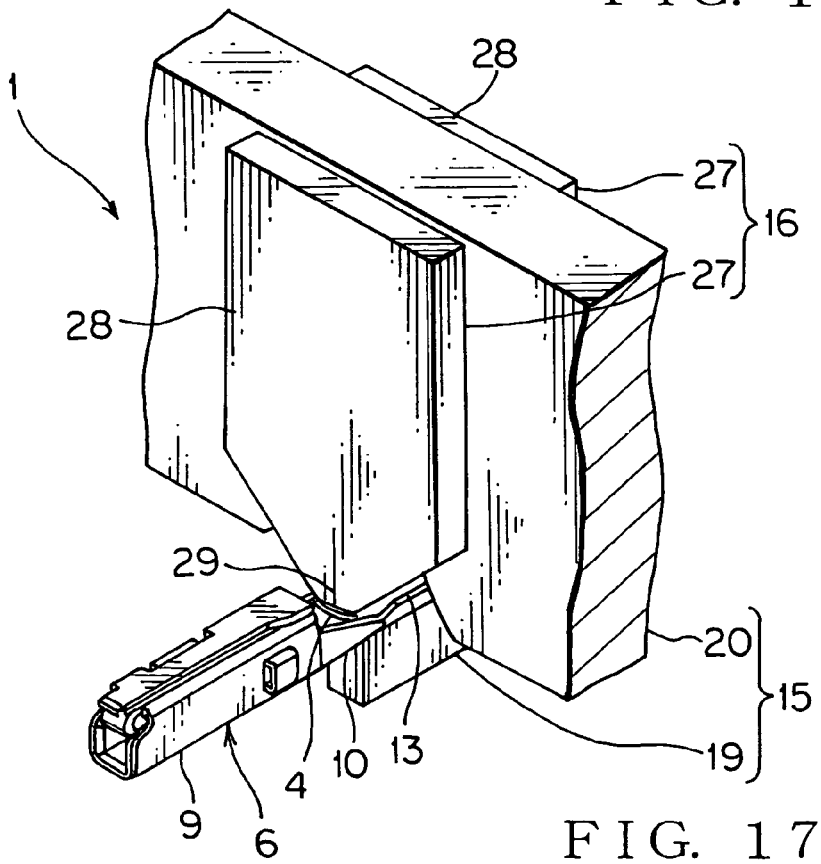
FIG. 17 is an explanatory view showing a state in which the stopping die of FIG. 16 is pressing the FFC conductor against a bottom wall of the terminal.

In thus-configured crimping apparatus 1 of the second embodiment, the terminal 6 is secured to the conductor 4 of the FFC 2 as described hereinafter. First, as shown in FIG. 15, the terminal 6 is laid on the anvil 19 with the crimper 20 and the anvil 19 having a space therebetween. Then, on the bottom wall 12 of the terminal 6, the exposed conductor 4 which is an end of the FFC 2 is arranged. Meanwhile, the rods 24, 26 of the air cylinders 17, 18 have been retracted. Then, the rod 26 of the air cylinder 18 extends so that, as shown in FIG. 16, the leading end of the convex portion 29 of the stopping die 27 contacts with the conductor 4 of the FFC 2. A further extension of the rod 26 makes the convex portion 29 of the stopping die 27 press the conductor 4 against the bottom wall 12. Thereby, as shown in FIG. 17, the conductor 4 of the FFC is bent along the bottom wall 12 to closely contact the bottom wall 12.

Figure 18:
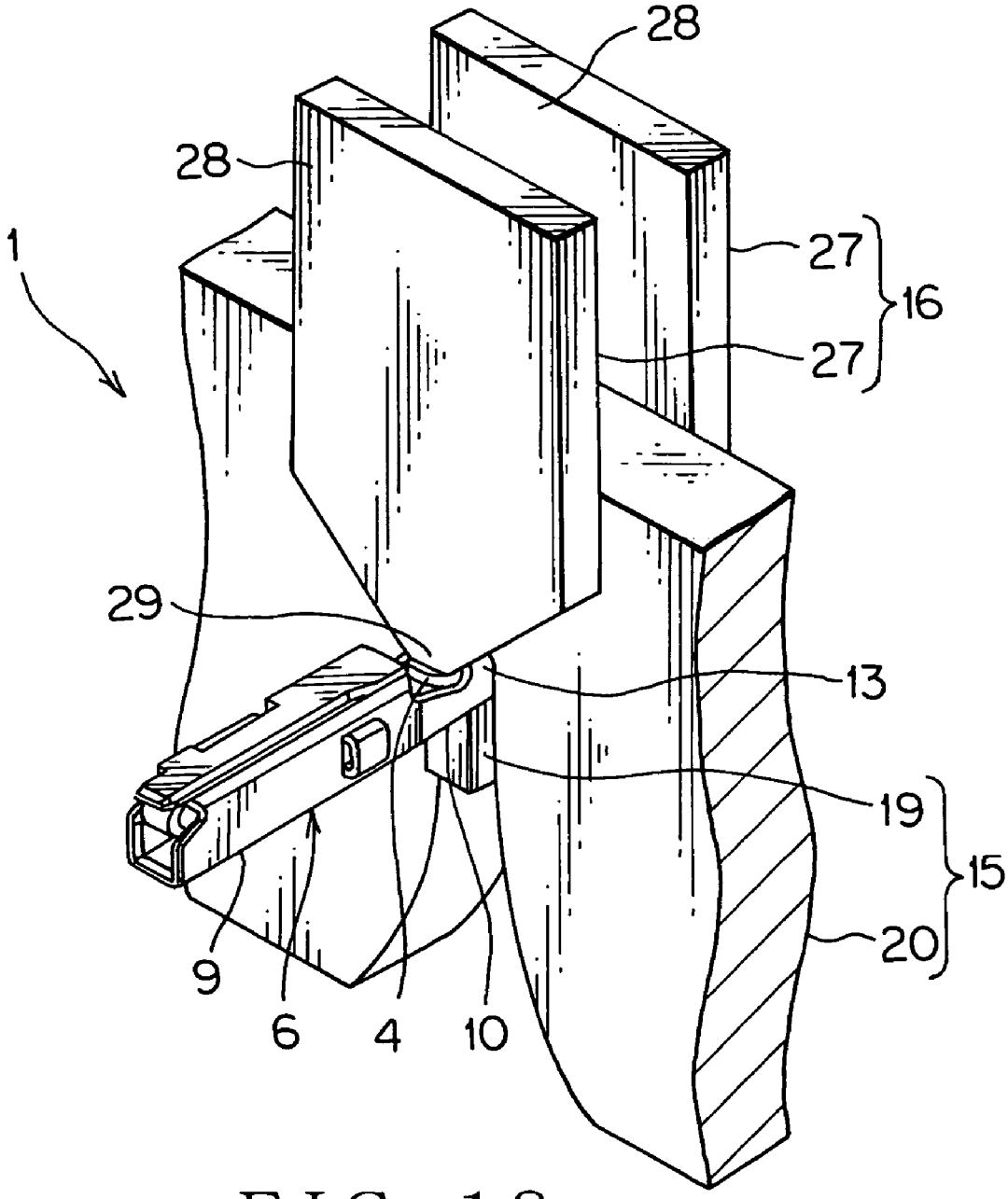
FIG. 18 is an explanatory view showing a state in which the anvil and the crimper of FIG. 17 have come close to each other.

Then, the rod 26 of the air cylinder 18 gradually retracts while the rod 24 of the air cylinder 17 gradually extends. Thereby, as shown in FIG. 18, the crimper 20 comes close to the anvil 19 with the stopping die 27 pressing the conductor 4 of the FFC 2 against the bottom wall 12. This crimps the crimping pieces 13, 14 with the terminal 6 and the conductor 4 of the FFC 2 being pinched between the anvil 19 and the crimper 20, so that the terminal 6 is secured to the FFC 2. Thus, the anvil 19 and the crimper 20 crimp the crimping pieces 13, 14 with the stopping die 27 pressing the conductor 4 of the FFC 2 against the bottom wall 12 to fit the conductor 4 to the terminal 6.

Then, the rod 24 of the air cylinder 17 retracts so that the crimper 20 comes apart from the anvil 19 to take the terminal 6 off the anvil 19. In the same way as described above, a next terminal 6 is laid on the anvil 19 and a next conductor 4 of the FFC 2 is arranged on the bottom wall 12 of the terminal 6 to secure the terminal 6 to the FFC 2.

Regarding the second embodiment, in the same way as the first embodiment, the pressing portion 16 presses the conductor 4 of the FFC 2 against the bottom wall bottom wall 12 of the terminal 6 so that the conductor 4 can be fitted on the crimping portion 15. This does not require another die used when the terminal 6 is fitted to the conductor 4 of the FFC 2, allowing a less cost increase without an additional die.

Furthermore, the pressing portion 16 presses the conductor 4 of the FFC 2 against the bottom wall 12 of the terminal 6 so that the relative shift of the conductor 4 and the terminal 6 is prevented when the conductor 4 is fitted to the terminal 6. Thus, the terminal 6 is surely secured to the conductor 4 of the FFC 2.

Since the pressing portion 16 has the stopping dies 27 supported by the crimper 20 slidably in directions in which the crimper 20 and the anvil 19 of the crimping portion 15 come close to and apart from each other, another die is not required when the terminal 6 is fitted to the conductor 4 of the FFC 2, along a lesser cost increase.

The plurality of stopping dies 27 are arranged along in a longitudinal direction of the terminal 6, so that the stopping dies 27 surely press the conductor 4 of the FFC 2 against the bottom wall 12 of the terminal 6. The stopping dies 27 press the conductor 4 at plural points, preventing an undesirable shift of the pressed conductor 4. Thus, the terminal 6 is surely fitted to the conductor 4 of the FFC 2.

The discussed embodiments utilize the FFC 2 as a flat circuit. However, in the present invention, another flat band circuit such as a flexible printed circuit may be used.

In the discussed embodiments, the terminal 6 has the electrical contact portion 9 that is a receptacle of a barrel type. However, in the present invention, the electrical contact portion 9 of the terminal 6 may be a male type one consisting of a rod or a plate. In the discussed embodiments, a pair of the stopping bars 22 or stopping dies 27 are provided. However, in the present invention, more than two of the stopping bars 22 or stopping dies 27 may be provided.

The discussed embodiments are representative aspects of the present invention and do not intend to limit the present invention. That is, the present invention can be embodied in modified aspects within the spirit of the present invention.

What is claimed is:

1. A crimping apparatus for positioning a conductor of a flat circuit on a bottom wall of an electrical connection portion of a terminal and for crimping the terminal by a crimping piece raised from the bottom wall to press-fit the conductor to the terminal, the crimping apparatus comprising:

pressing means for pressing the conductor positioned on the bottom wall against the bottom wall; and crimping means for crimping the crimping piece with the conductor being pressed on the bottom wall by the pressing means, wherein the conductor is covered with insulating material except for at least one end portion and is bent along the bottom wall at an uninsulated end portion so that the uninsulated end portion closely contacts the bottom wall when pressed by the pressing means, and wherein the crimping means has a pair of dies coming close to and apart from each other to pinch and crimp the crimping piece, and the pressing means has a plurality of stopping bars, each bar passing through a through hole defined in one die and retractively extending toward the other die, and the plurality of the stopping bars are disposed parallel to each other across the width of the terminal.

* * * * *